US009396658B2

(12) United States Patent
Shimotani et al.

(10) Patent No.: US 9,396,658 B2
(45) Date of Patent: Jul. 19, 2016

(54) ON-VEHICLE INFORMATION PROCESSING DEVICE

(71) Applicants: Mitsuo Shimotani, Tokyo (JP); Hidehiko Ohki, Tokyo (JP); Makoto Mikuriya, Tokyo (JP)

(72) Inventors: Mitsuo Shimotani, Tokyo (JP); Hidehiko Ohki, Tokyo (JP); Makoto Mikuriya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/420,312

(22) PCT Filed: Oct. 4, 2012

(86) PCT No.: PCT/JP2012/075793

§ 371 (c)(1),
(2) Date: Feb. 6, 2015

(87) PCT Pub. No.: WO2014/054151

PCT Pub. Date: Apr. 10, 2014

(65) Prior Publication Data

US 2015/0206434 A1 Jul. 23, 2015

(51) Int. Cl.
*G08G 1/16* (2006.01)

(52) U.S. Cl.
CPC ..... *G08G 1/163* (2013.01); *G08G 1/161* (2013.01); *G08G 1/166* (2013.01); *G08G 1/167* (2013.01)

(58) Field of Classification Search
CPC ..... G08G 1/163; G08G 1/167; G08G 1/161; G08G 1/166
See application file for complete search history.

(56) References Cited

U.S. PATENT DOCUMENTS

| | | | | |
|---|---|---|---|---|
| 6,580,976 | B1 | 6/2003 | Belcea | |
| 2003/0097477 | A1* | 5/2003 | Vossler | H04L 12/4612 709/248 |
| 2009/0276135 | A1 | 11/2009 | Hagemann et al. | |
| 2010/0299001 | A1 | 11/2010 | Suzuki | |
| 2011/0270513 | A1 | 11/2011 | Shida | |
| 2012/0136538 | A1* | 5/2012 | Schepp | B60W 30/09 701/41 |

FOREIGN PATENT DOCUMENTS

| | | | |
|---|---|---|---|
| CN | 101193768 | A | 6/2008 |
| CN | 101264762 | A | 9/2008 |
| CN | 102292752 | A | 12/2011 |
| JP | 2004-343399 | A | 12/2004 |
| JP | 2006-275673 | A | 10/2006 |
| JP | 2008-204094 | A | 9/2008 |
| JP | 2009-48564 | A | 3/2009 |

(Continued)

*Primary Examiner* — Rodney Butler
(74) *Attorney, Agent, or Firm* — Birch, Stewart, Kolasch & Birch, LLP

(57) ABSTRACT

An object of the present invention is to provide an on-vehicle information processing device that is capable of sufficiently calling attention of a driver of an own vehicle. The on-vehicle information processing device according to the present invention includes: an other-vehicle position detector that detects a position of another vehicle existing in a vicinity of an own vehicle; a communication unit that acquires, via communication, other-vehicle information including driver dynamic information from the other vehicle whose position is detected by the other-vehicle position detector, the driver dynamic information indicating a current state of activity of a driver of the other vehicle; and a controller that controls calling attention of a driver of the own vehicle or traveling of the own vehicle based on the driver dynamic information acquired by the communication unit.

20 Claims, 15 Drawing Sheets

(56) References Cited

FOREIGN PATENT DOCUMENTS

| | | | |
|---|---|---|---|
| JP | 2009-75895 | A | 4/2009 |
| JP | 2009-134334 | A | 6/2009 |
| JP | 2010-066817 | A | 3/2010 |
| JP | 2010-086269 | A | 4/2010 |
| JP | 2010-217956 | A | 9/2010 |
| JP | 2010-272083 | A | 12/2010 |
| JP | 2011-221573 | A | 4/2011 |
| JP | 2011-175388 | A | 9/2011 |
| JP | 2012-186742 | A | 9/2012 |
| WO | WO 2010/084568 | A1 | 7/2010 |
| WO | 2010-205123 | A | 9/2010 |
| WO | WO 2012/056688 | A1 | 5/2012 |

* cited by examiner

F I G . 1 0

| DRIVER DYNAMIC INFORMATION | LEVEL L1 |
|---|---|
| NORMAL | 0 |
| OPERATING EQUIPMENT | 2 |
| RECEIVING INCOMING H/F CALL | 3 |
| PERFORMING H/F COMMUNICATION | 1 |
| CHECKING TELEMATICS INFORMATION | 3 |
| LISTENING TO MUSIC AT HIGH VOLUME | 4 |
| PROVIDING ROUTE GUIDANCE | 2 |
| DECREASING WAKEFULNESS | 5 |

F I G . 1 1

| DRIVER STATIC INFORMATION | LEVEL L2 |
|---|---|
| GOLD DRIVER'S LICENSE | 0 |
| NORMAL DRIVER'S LICENSE | 1 |
| VEHICLE WITH DRIVERS' SIGN DISPLAY | 2 |
| WITH MANY ACCIDENTS | 3 |

F I G . 1 2

| FELLOW PASSENGER | LEVEL L3 |
|---|---|
| WITHOUT FELLOW PASSENGER | 0 |
| WITH FELLOW PASSENGER | 1 |
| WITH FELLOW PASSENGER (CONVERSATION) | 3 |
| WITH FELLOW PASSENGER (QUARREL) | 3 |
| WITH FELLOW PASSENGER (BABY CRYING) | 4 |

F I G . 1 3

| VEHICLE POSITION | COEFFICIENT R |
|---|---|
| FRONT SAME LANE | 1 |
| FRONT ANOTHER LANE | 0.3 |
| BEHIND SAME LANE | 0.5 |
| BEHIND ANOTHER LANE | 0.1 |

| ATTENTION LEVEL L | ATTENTION-CALLING METHOD | DISPLAY | SOUND |
|---|---|---|---|
| L<1 | ONLY OTHER VEHICLE DISPLAY | ◁ | — |
| 1≦L<3 | DISPLAY OTHER VEHICLE PROMINENTLY | ◁ | — |
| 3≦L<5 | ADDITIONALLY USE SOUND EFFECT FOR WARNING | ◁ | POP |
| L≧5 | AURAL WARNING AND PROMINENT DISPLAY OF DANGER (USING TELOP ETC.) | DANGER! | PROCEED WITH CAUTION |

ON-VEHICLE INFORMATION PROCESSING DEVICE

TECHNICAL FIELD

The present invention relates to an on-vehicle information processing device that controls calling attention of a driver of an own vehicle or traveling of the own vehicle based on other-vehicle information acquired from another vehicle.

BACKGROUND ART

There has been a vehicle control device that performs communication with another vehicle, acquires a profile, such as driver's license information and a traffic accident history, of a driver of the other vehicle, judges whether or not the other vehicle is a vehicle to which attention is to be paid, and displays a result of the judgment on a display device to call attention of a driver of an own vehicle (see, for example, Patent Document 1).

In Patent Document 1, the judgment on whether or not the other vehicle is the vehicle to which attention is to be paid is made based on information that is unique to the driver of the other vehicle (static information), and some degree of attention-calling effect is produced.

PRIOR ART DOCUMENT

Patent Document

Patent Document 1: Japanese Patent Application Laid-Open No. 2009-134334

SUMMARY OF INVENTION

Problems to be Solved by the Invention

When a driver operates in-vehicle equipment existing in a vehicle or when the driver performs hands-free (H/F) communication, for example, a task (work) of the driver typically increases and a time required for perception and judgment during driving tends to increase, compared to when the driver drives the vehicle normally. As such, depending on a current state of activity of a driver, a vehicle driven by the driver can fall under a vehicle to which attention is to be paid.

In Patent Document 1, however, judgment on whether or not another vehicle is a vehicle to which attention is to be paid is not made based on a current state of activity of a driver of the other vehicle. Therefore, attention of a driver of an own vehicle is not sufficiently called to the other vehicle to which attention is to be paid.

The present invention has been conceived to solve the aforementioned problems. An object of the present invention is to provide an on-vehicle information processing device that is capable of sufficiently calling attention of the driver of the own vehicle.

Means for Solving the Problems

To solve the aforementioned problems, an on-vehicle information processing device according to the present invention includes: an other-vehicle position detector that detects a position of another vehicle existing in a vicinity of an own vehicle; a communication unit that acquires, via communication, other-vehicle information including driver dynamic information from the other vehicle whose position is detected by the other-vehicle position detector, the driver dynamic information indicating a current state of activity of a driver of the other vehicle; and a controller that controls calling attention of a driver of the own vehicle or traveling of the own vehicle based on the driver dynamic information acquired by the communication unit.

Effects of the Invention

The on-vehicle information processing device according to the present invention includes: an other-vehicle position detector that detects a position of another vehicle existing in a vicinity of an own vehicle; a communication unit that acquires, via communication, other-vehicle information including driver dynamic information from the other vehicle whose position is detected by the other-vehicle position detector, the driver dynamic information indicating a current state of activity of a driver of the other vehicle; and a controller that controls calling attention of a driver of the own vehicle or traveling of the own vehicle based on the driver dynamic information acquired by the communication unit. As a result, attention of the driver of the own vehicle can sufficiently be called.

The object, features, aspects and advantages of the present invention become more apparent from the following detailed description and the accompanying drawings.

BRIEF DESCRIPTION OF DRAWINGS

FIG. 10 shows an example of a relation between driver dynamic information and a level according to Embodiment 5 of the present invention.

FIG. 11 shows an example of a relation between driver static information and a level according to Embodiment 5 of the present invention.

FIG. 12 shows an example of a relation between a state of a fellow passenger and a level according to Embodiment 5 of the present invention.

FIG. 13 shows an example of a relation between a vehicle position and a coefficient according to Embodiment 5 of the present invention.

DESCRIPTION OF EMBODIMENTS

Embodiments of the present invention are described below based on the drawings.

Embodiment 1

A configuration of an on-vehicle information processing device according to Embodiment 1 of the present invention is described first.

Figure 1:
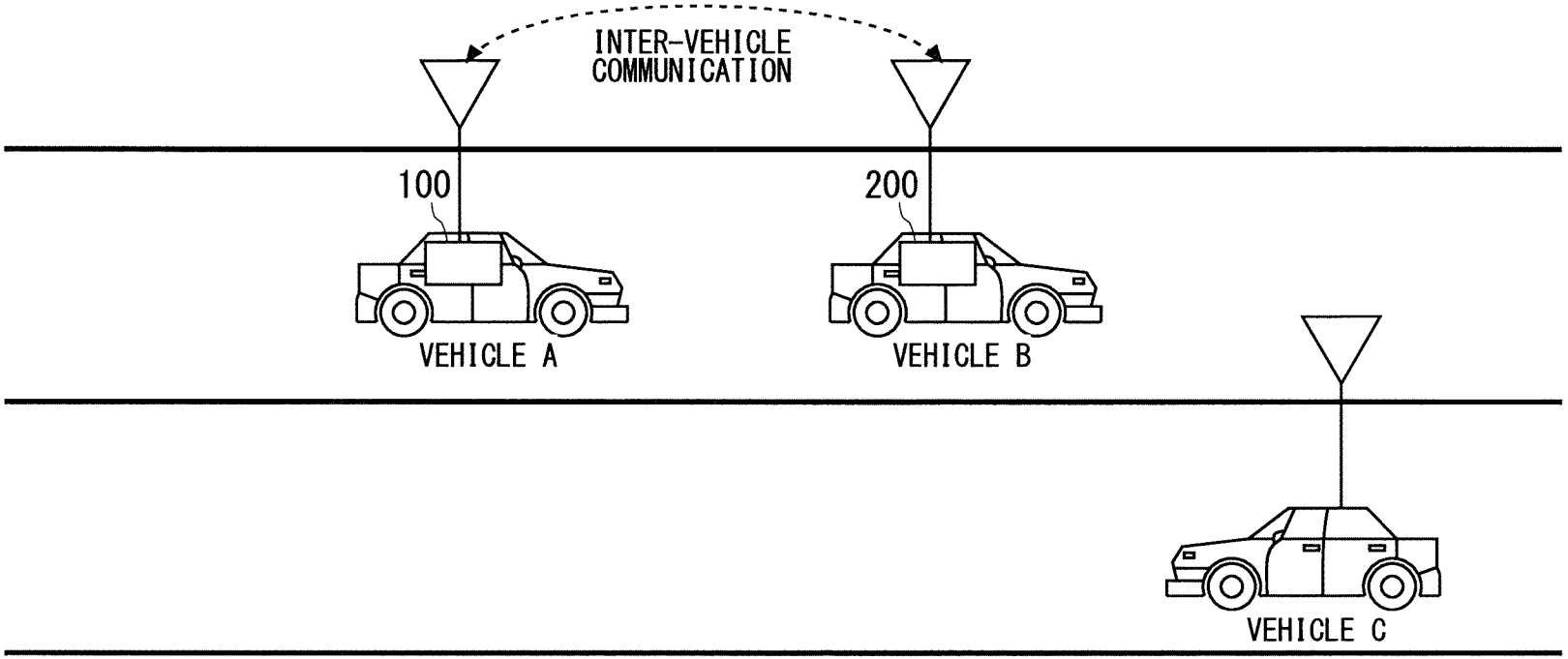
FIG. 1 shows application examples of on-vehicle information processing devices according to Embodiment 1 of the present invention.

FIG. 1 shows application examples of on-vehicle information processing devices 100 and 200 according to Embodiment 1.

As illustrated in FIG. 1, vehicles A and B travel in the same direction, and a vehicle C travels along an oncoming lane. The vehicles A and B are respectively equipped with the on-vehicle information processing devices 100 and 200, and are capable of communicating with each other via inter-vehicle communication.

Hereinafter, in Embodiment 1, the on-vehicle information processing device 100 is described as a device at a receiving end that receives information transmitted from the vehicle B, and the on-vehicle information processing device 200 is described as a device at a transmitting end that transmits information to the vehicle A.

Figure 2:
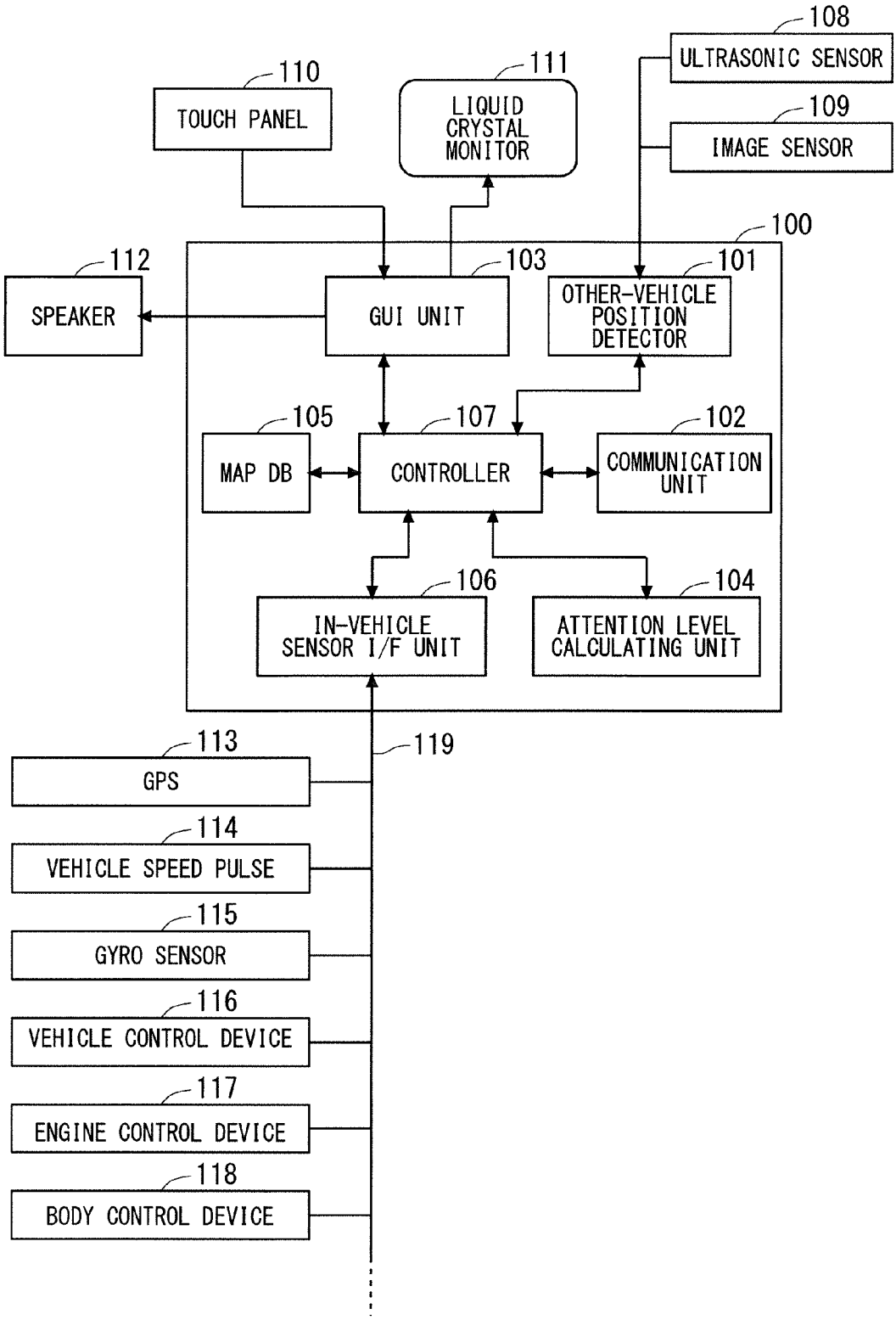
FIG. 2 is a block diagram showing an example of a configuration of an on-vehicle information processing device according to Embodiment 1 of the present invention.

FIG. 2 is a block diagram showing an example of a configuration of the on-vehicle information processing device 100. The following description on FIG. 2 is made on the assumption that an own vehicle is the vehicle A, and another vehicle is the vehicle B.

As shown in FIG. 2, the on-vehicle information processing device 100 includes an other-vehicle position detector 101, a communication unit 102, a graphical user interface (GUI) unit 103, an attention level calculating unit 104, a map database (DB) 105, an in-vehicle sensor interface (I/F) unit 106, and a controller 107.

The other-vehicle position detector 101 is connected to an ultrasonic sensor 108 and an image sensor 109. The other-vehicle position detector 101 detects a relative position of the vehicle B (another vehicle) existing in the vicinity of the vehicle A (an own vehicle) based on a result of detection performed by the ultrasonic sensor 108 or the image sensor 109. An example of the image sensor 109 is a camera.

The communication unit 102 performs inter-vehicle communication with the vehicle B, and acquires other-vehicle information from the vehicle B. The other-vehicle information herein refers to information including all information regarding the other vehicle (the vehicle B). The communication unit may be any unit including a wireless local area network (LAN), ultra-wide band (UWB), and optical communication.

The GUI unit 103 is connected to a touch panel 110, a liquid crystal monitor 111 (a display), and a speaker 112. The GUI unit 103 inputs operating information of a driver acquired via the touch panel 110 into the controller 107. The GUI unit 103 also outputs display information input from the controller 107 to the liquid crystal monitor 111, and outputs sound information input from the controller 107 to the speaker 112.

The attention level calculating unit 104 calculates an attention level with respect to the vehicle B based on the other-vehicle information acquired from the vehicle B via the communication unit 102. The attention level herein refers to a level of attention that a driver of the vehicle A should pay to the vehicle B. At least two (stages of) attention levels are calculated by the attention level calculating unit 104.

The map DB 105 stores therein map data.

The in-vehicle sensor I/F unit 106 is connected, via an in-vehicle LAN 119, to a global positioning system (GPS) 113, a vehicle speed pulse 114, a gyro sensor 115, a vehicle control device 116, an engine control device 117, a body control device 118, and the like. The controller 107 is capable of receiving various types of information and issuing instructions via the in-vehicle LAN 119 and the in-vehicle sensor I/F unit 106.

Information acquired by each of the GPS 113, the vehicle speed pulse 114, and the gyro sensor 115 is input into the controller 107 via the in-vehicle sensor I/F unit 106, and a position of the own vehicle is detected by the controller 107. That is to say, the controller 107 has a function of detecting the position of the own vehicle.

The vehicle control device 116 inputs a driver's operation from a brake pedal, an accelerator pedal, or a steering wheel, and controls traveling of the own vehicle. For example, the vehicle control device 116 controls an engine speed, a brake-system device, and the like to control the speed of the own vehicle, and controls an attitude of a shaft and the like to control a travel direction of the own vehicle. The vehicle control device 116 also controls a function of performing a semi-automatic operation such as automatic cruising.

The engine control device 117 performs fuel control and ignition timing control.

The body control device 118 controls operations that are not directly related to traveling of the own vehicle. For example, the body control device 118 controls driving of windshield wipers, transfer of lighting information, lighting of directional indicators, opening and closing of doors, and opening and closing of windows.

The controller 107 controls each of the components of the on-vehicle information processing device 100.

Figure 3:
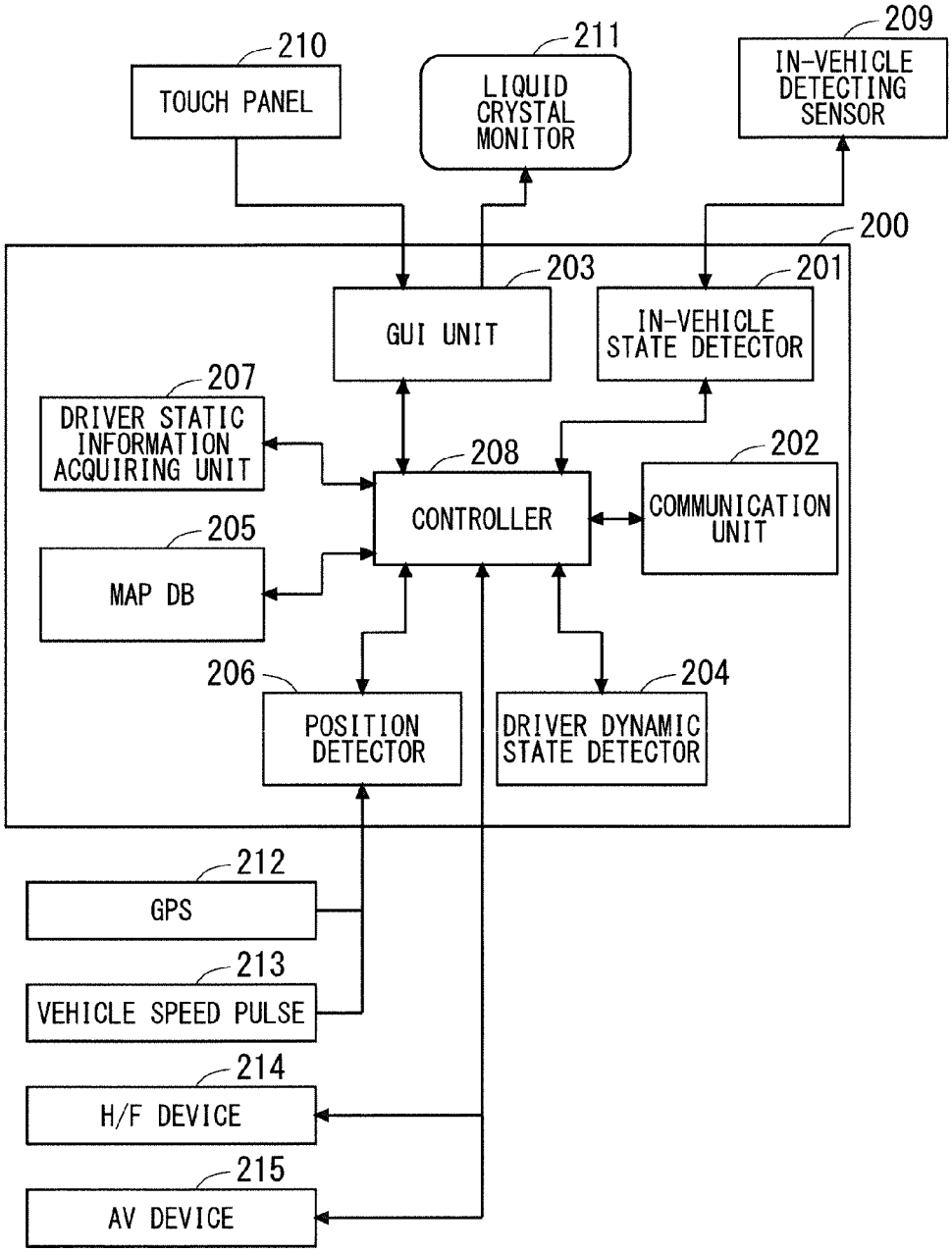
FIG. 3 is a block diagram showing an example of a configuration of another on-vehicle information processing device according to Embodiment 1 of the present invention.

FIG. 3 is a block diagram showing an example of a configuration of the on-vehicle information processing device 200. The following description on FIG. 3 is made on the assumption that an own vehicle is the vehicle B, and another vehicle is the vehicle A.

As shown in FIG. 3, the on-vehicle information processing device 200 includes an in-vehicle state detector 201, a communication unit 202, a GUI unit 203, a driver dynamic state detector 204, a map DB 205, a position detector 206, a driver static information acquiring unit 207, and a controller 208.

The in-vehicle state detector 201 is connected to an in-vehicle detecting sensor 209. The in-vehicle state detector 201 detects an internal state of the vehicle B based on a result of detection performed by the in-vehicle detecting sensor 209 to detect the presence or absence of a fellow passenger and a state of the fellow passenger, for example. Examples of the in-vehicle detecting sensor 209 are a camera as an image sensor, a pressure sensor provided for each seat to detect whether or not a fellow passenger sits in the seat, and a microphone acquiring sound information in the vehicle B. Information indicating the internal state of the vehicle B detected by the in-vehicle state detector 201 may be transmitted, as own-vehicle internal information, by the communication unit 202 to the vehicle A by including the own-vehicle internal information in own-vehicle information.

The communication unit 202 performs inter-vehicle communication with the vehicle A, and transmits the own-vehicle information to the vehicle A. The own-vehicle information herein refers to information including all information regarding the own-vehicle (the vehicle B) to be transmitted the other vehicle (vehicle A). The own-vehicle information corresponds to the other-vehicle information acquired by the communication unit 102 shown in FIG. 2. The communication unit may be any unit including a wireless LAN, UWB, and optical communication.

The GUI unit 203 is connected to a touch panel 210 and a liquid crystal monitor 211. The GUI unit 203 inputs operating information of a driver acquired via the touch panel 210 into the controller 208. The GUI unit 203 also outputs display information input from the controller 208 to the liquid crystal monitor 211.

The driver dynamic state detector 204 detects a current state of activity of a driver of the vehicle B. Information indicating the current state of activity of the driver detected by the driver dynamic state detector 204 may be transmitted, as driver dynamic information, by the communication unit 202 to the vehicle A by including the driver dynamic information in the own-vehicle information.

The map DB 205 stores therein map data.

The position detector 206 is connected to a GPS 212 and a vehicle speed pulse 213. The position detector 206 detects a position of the own vehicle based on information acquired by each of the GPS 212 and the vehicle speed pulse 213.

The driver static information acquiring unit 207 acquires driver static information that is unique to the driver of the vehicle B. Examples of the driver static information are information regarding drivers' sign display (information indicating beginner drivers, aged drivers, or the like), driver's license information, and information regarding a traffic accident history. The driver static information acquired by the driver static information acquiring unit 207 may be transmitted by the communication unit 202 to the vehicle A by including the driver static information in the own-vehicle information.

The controller 208 controls each of the components of the on-vehicle information processing device 200.

A hands-free (H/F) device 214 is a device for performing hands-free (H/F) communication, and is connected to the controller 208.

An audio visual (AV) device 215 is a device for playing back audio or video, such as radio and music, and is connected to the controller 208.

The current state of activity of the driver (a dynamic state of the driver) detected by the driver dynamic state detector 204 is described next.

The state of activity of the driver is broadly classified into the following three categories.

The first category of the state of activity of the driver is an operating state of in-vehicle equipment (the H/F device 214 and the AV device 215 in FIG. 3) that is operable by the driver of the own vehicle and exists in the own vehicle. When the driver operates the in-vehicle equipment, the driver might not able to focus on driving as attention of the driver is paid to the operation. The driver dynamic state detector 204 detects the above-mentioned operating state of the in-vehicle equipment. The following describes examples of the operating state of the in-vehicle equipment.

One example of the operating state of the in-vehicle equipment is a state in which the in-vehicle equipment is operated. For example, when the H/F device 214 or the AV device 215 is operated, a signal indicating that the H/F device 214 or the AV device 215 is operated is input from the H/F device 214 or the AV device 215 into the driver dynamic state detector 204 via the controller 208. The driver dynamic state detector 204 detects the state in which the H/F device 214 or the AV device 215 is operated by detecting the signal indicating that the H/F device 214 or the AV device 215 is operated.

Another example of the operating state of the in-vehicle equipment is a state in which the in-vehicle equipment is connected to a portable communication terminal. For example, when a car navigation device, which is the in-vehicle equipment, is connected to a portable communication terminal, the car navigation device can recognize a situation of an operation performed by the portable communication terminal by receiving information regarding the operation performed by the portable communication terminal. The driver dynamic state detector 204 detects a signal indicating that the portable communication terminal is operated to recognize a state in which the portable communication terminal is operated. The car navigation device and the portable communication terminal may be connected to each other by wires (e.g., by universal serial bus (USB)) or may be connected to each other wirelessly (e.g., by Bluetooth (registered trademark) and by a wireless LAN).

Yet another example of the operating state of the in-vehicle equipment is a state in which, via the in-vehicle equipment, hands-free communication is performed or an outgoing hands-free call is initiated. For example, when, via the H/F device 214, which is the in-vehicle equipment, hands-free communication is performed or an outgoing hands-free call is initiated, the driver dynamic state detector 204 detects a signal indicating that hands-free communication is performed or an outgoing hands-free call is initiated to recognize a state in which hands-free communication is performed or an outgoing hands-free call is initiated.

The second category of the state of activity of the driver is an information presenting state of the in-vehicle equipment to the driver of the own vehicle. The presented information herein refers to new information other than information presented regularly. Specific examples of the presented information are guidance information presented at a right and a left turn when route guidance to a destination is provided, and traffic congestion information presented in the event of traffic congestion, a traffic accident, and the like. When the in-vehicle equipment presents information to the driver of the own vehicle, the driver might not able to focus on driving as attention of the driver is paid to the presented information. The driver dynamic state detector 204 detects the above-mentioned information presenting state of the in-vehicle equipment. The following describes examples of the information presenting state of the in-vehicle equipment.

One example of the information presenting state is a state in which the in-vehicle equipment outputs music at a volume that is equal to or higher than a predetermined volume. For example, in a case where the AV device 215 outputs music, when the AV device 215 is operated so that the volume of the music becomes equal to or higher than the predetermined volume, a signal indicating that the AV device 215 is operated so that the volume of the music becomes equal to or higher than the predetermined volume is input into the driver dynamic state detector 204. The driver dynamic state detector 204 detects the signal indicating that the AV device 215 is operated so that the volume of the music becomes equal to or higher than the predetermined volume, to recognize a state in which the AV device 215 outputs the music at the volume that is equal to or higher than the predetermined volume.

Another example of the information presenting state is a state in which the in-vehicle equipment announces an incoming call. For example, when the H/F device 214 receives an incoming call from an outside source and announces the incoming call, a signal indicating that the incoming call is received is input into the driver dynamic state detector 204. The driver dynamic state detector 204 detects the signal indicating that the incoming call is received to recognize a state in which the H/F device 214 receives the incoming call from the outside source and announces the incoming call.

Yet another example of the information presenting state is a state in which information acquired from an outside source is presented to the driver. For example, when information is acquired from an outside source and presented to the driver by using a telematics service, the driver dynamic state detector 204 detects that the information has been acquired from the outside source to recognize a state in which the information is acquired from the outside source and presented to the driver.

Yet another example of the information presenting state is a state in which the driver checks information presented by the in-vehicle device. For example, the driver dynamic state detector 204 acquires (detects) information indicating that a sequence of operations to be performed in the in-vehicle device (a sequence of operations performed to check the information) is not ended, to recognize a state in which the driver checks the information presented by the in-vehicle device.

The third category of the state of activity of the driver is a state of a travel history or a travel schedule of the driver on a current day. Specific examples of the state of the travel history or the travel schedule are a state of a time period for which the driver drives after the start of driving and a state of a distance from a current position to a destination. For example, a degree of fatigue of the driver can be known from a continuous travel time of the driver. The driver typically becomes less attentive especially immediately after a sleep break. Similarly, attention of the driver is likely to be distracted when a current position is close to a destination, as the driver looks around for the destination carefully. The driver dynamic state detector 204 acquires information regarding the travel history or the travel schedule on the current day from the navigation device to detect a state of the driver.

As described above, the current state of activity (a dynamic state) of the driver detected by the driver dynamic state detector 204 may be transmitted, as the driver dynamic information, by the communication unit 202 to the other vehicle (vehicle A) by including the driver dynamic information in the own-vehicle information.

Operations of the on-vehicle information processing devices 100 and 200 according to Embodiment 1 are described next. The following describes a case where the on-vehicle information processing device 100 mounted in the vehicle A and the on-vehicle information processing device 200 mounted in the vehicle B perform inter-vehicle communication with each other.

Figure 4:
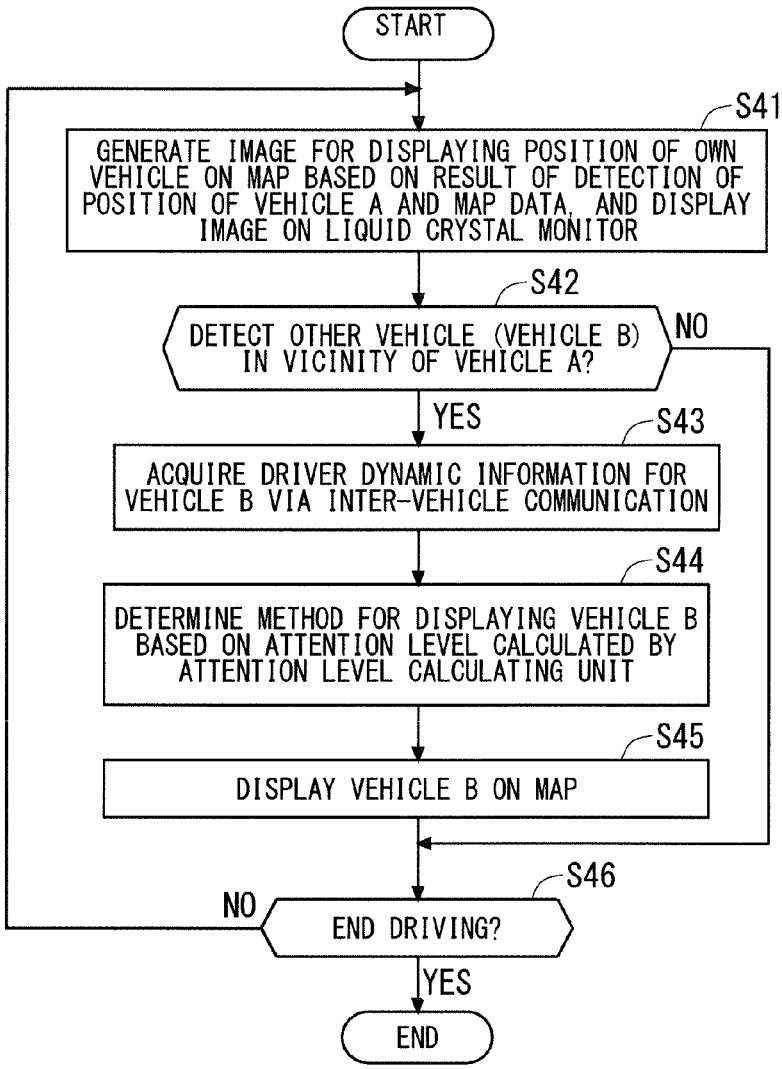
FIG. 4 is a flow chart showing an example of an operation of the on-vehicle information processing device according to Embodiment 1 of the present invention.

FIG. 4 is a flow chart showing an example of an operation of the on-vehicle information processing device 100.

In step S41, the controller 107 detects a current position of the vehicle A, which is the own vehicle, based on information acquired by the GPS 113, the vehicle speed pulse 114, and the gyro sensor 115. The controller 107 then generates image data for displaying the position of the own vehicle (the position of the vehicle A) on a map based on a result of the detection of the position of the vehicle A and the map data stored in the map DB 105. The image data thus generated is input into the liquid crystal monitor 111 via the GUI unit 103, and an image is displayed on the liquid crystal monitor 111.

In step S42, judgment on whether the vehicle B, which is the other vehicle existing in the vicinity of the vehicle A, is detected or not is made. When the vehicle B is detected, processing transitions to step S43. When the vehicle B is not detected, processing transitions to step S46. The vehicle B is detected by the other-vehicle position detector 101 based on information acquired by the ultrasonic sensor 108 or the image sensor 109.

In step S43, the communication unit 102 acquires the other-vehicle information including the driver dynamic information for the vehicle B via inter-vehicle communication. The other-vehicle information is acquired at predetermine time intervals (e.g., every 0.1 seconds). The vehicle A may acquire the other-vehicle information from the vehicle B after making a request for communication to the vehicle B. When the vehicle B constantly transmits the other-vehicle information, the vehicle A may acquire the other-vehicle information transmitted from the vehicle B.

In step S44, the attention level calculating unit 104 calculates the attention level based on the driver dynamic information for the vehicle B included in the other-vehicle information. In Embodiment 1, the attention level calculating unit 104 calculates two (stages of) attention levels that indicate "whether there is a need to pay attention or not".

The controller 107 then determines a method for displaying the vehicle B on a map based on the attention level calculated by the attention level calculating unit 104.

In step S45, the controller 107 outputs image data to the liquid crystal monitor 111 via the GUI unit 103 so that the vehicle B is displayed by the method determined in step S44. The liquid crystal monitor 111 displays the vehicle B on the map based on the image data input from the controller 107.

In step S46, judgment on whether driving of the vehicle A is ended or not is made. When driving of the vehicle A is ended, processing ends. When driving of the vehicle A is not ended, processing transitions to step S41.

Figure 5:
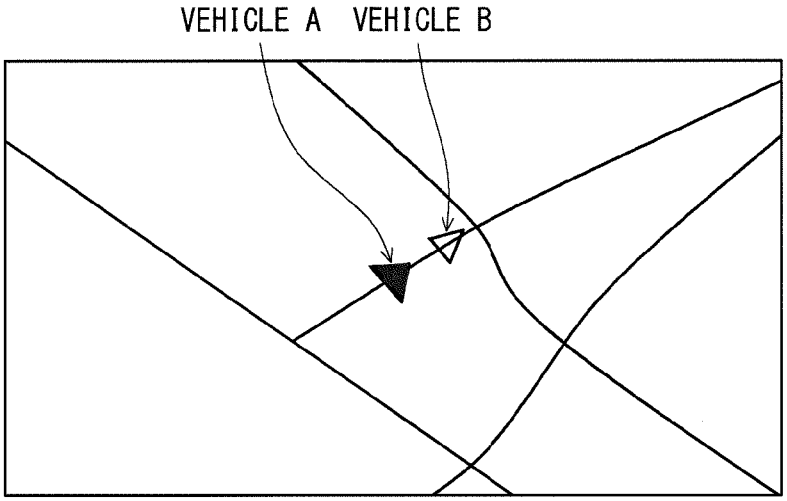
FIG. 5 shows an example of display achieved by the on-vehicle information processing device according to Embodiment 1 of the present invention.

FIG. 5 shows an example of display performed in the vehicle A when there is no need to pay attention to the vehicle B.

The attention level calculating unit 104 calculates the attention level based on the driver dynamic information included in the other-vehicle information acquired from the vehicle B. When the controller 107 judges that there is no need to pay attention to the vehicle B (i.e., the driver of the vehicle B is in a good dynamic state) based on the attention level calculated by the attention level calculating unit 104, the vehicle B is displayed on the liquid crystal monitor 111 so as to reflect the result of the judgment. For example, the vehicle B is displayed as an outlined triangle as shown in FIG. 5.

As a result, it becomes easy for the driver of the vehicle A to visually recognize that the vehicle B is not a vehicle that requires attention.

Figure 6:
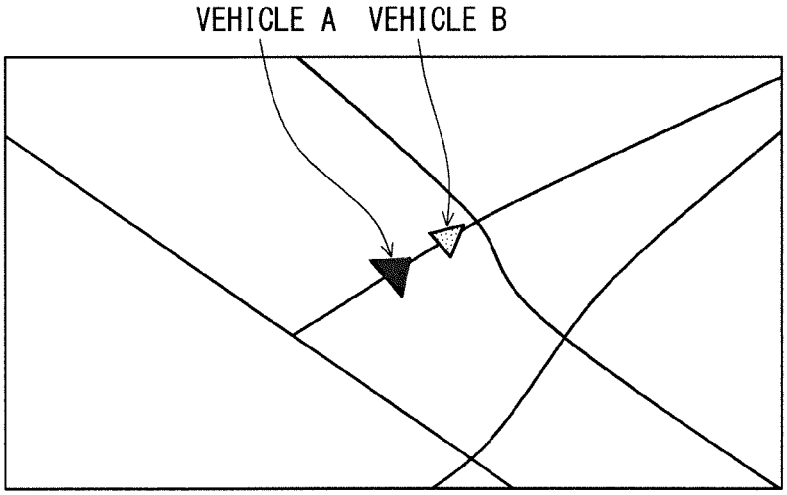
FIG. 6 shows another example of the display achieved by the on-vehicle information processing device according to Embodiment 1 of the present invention.

FIG. 6 shows an example of display performed in the vehicle A when there is a need to pay attention to the vehicle B.

The attention level calculating unit 104 calculates the attention level based on the driver dynamic information included in the other-vehicle information acquired from the vehicle B. When the controller 107 judges that there is a need to pay attention to the vehicle B (i.e., there is a need to pay attention to a dynamic state of the driver of the vehicle B) based on the attention level calculated by the attention level calculating unit 104, the vehicle B is displayed on the liquid crystal monitor 111 so as to reflect the result of the judgment. For example, the vehicle B is displayed by being filled with a different color from the vehicle A (by being hatched in a different manner from the vehicle A in FIG. 6) as shown in FIG. 6.

As a result, it becomes easy for the driver of the vehicle A to visually recognize that the vehicle B is the vehicle that requires attention.

Figure 7:
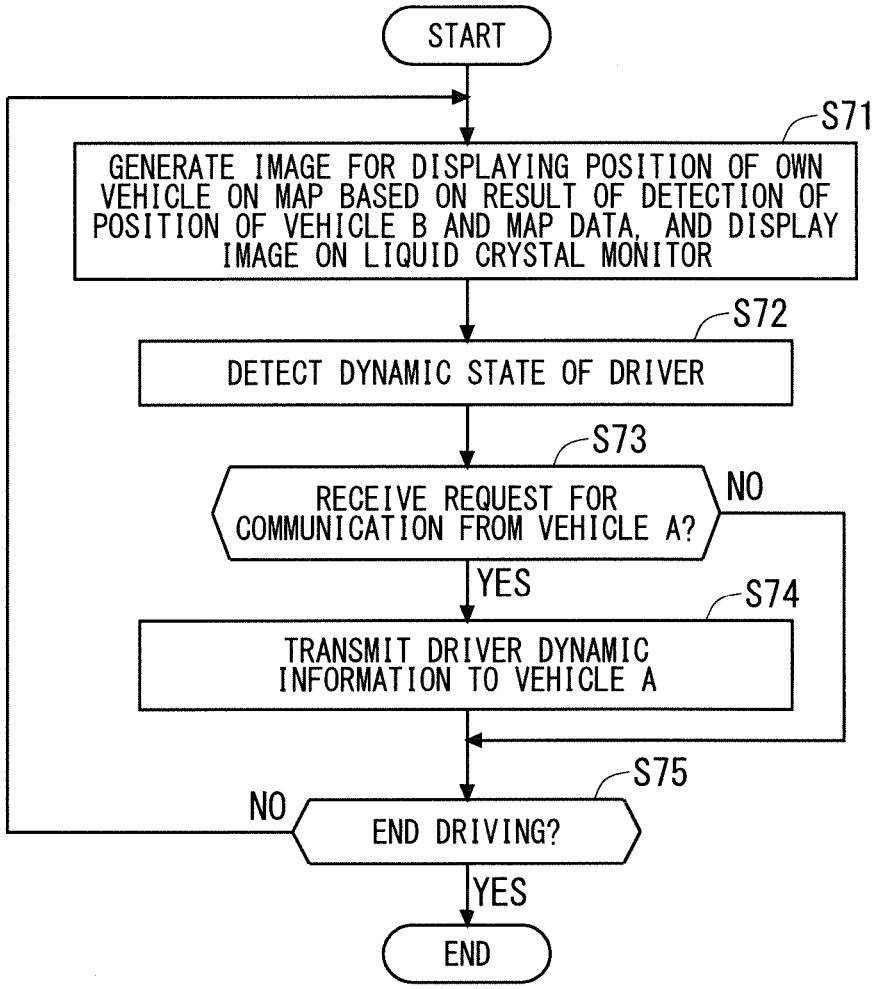
FIG. 7 is a flow chart showing an example of an operation of the on-vehicle information processing device according to Embodiment 1 of the present invention.

FIG. 7 is a flow chart showing an example of an operation of the on-vehicle information processing device 200.

In step S71, the controller 208 detects a current position of the vehicle B, which is the own vehicle, based on information acquired by the GPS 212 and the vehicle speed pulse 213. The controller 208 then generates image data for displaying the position of the own vehicle (the position of the vehicle B) on a map based on a result of the detection of the position of the vehicle B and the map data stored in the map DB 205. The image data thus generated is input into the liquid crystal monitor 211 via the GUI unit 203, and an image is displayed on the liquid crystal monitor 211.

In step S72, the driver dynamic state detector 204 detects a dynamic state of the driver of the vehicle B.

In step S73, the controller 208 judges whether or not there is a request for communication from the vehicle A, which is the other vehicle, via the communication unit 208. When there is the request for communication from the vehicle A, processing transitions to step S74. When there is no request for communication from the vehicle A, processing transitions to step S75. That is to say, the controller 208 controls the communication unit 202 so that the own-vehicle information is transmitted to the vehicle A when there is the request for communication from the vehicle A.

In step S74, information indicating the dynamic state of the driver detected by the driver dynamic state detector 204 is transmitted, as the driver dynamic information, by the communication unit 202 to the vehicle A by including the driver dynamic information in the own-vehicle information. The own-vehicle information transmitted in step S74 corresponds to the other-vehicle information acquired in step S43 shown in FIG. 4.

In step S75, judgment on whether driving of the vehicle B is ended or not is made. When driving of the vehicle B is ended, processing ends. When driving of the vehicle B is not ended, processing transitions to step S71.

Consequently, according to Embodiment 1, since whether the other vehicle is a vehicle to which attention is to be paid or not can easily be judged by varying the method for displaying the other vehicle based on the dynamic state of the driver of the other vehicle, attention of the driver of the own vehicle can sufficiently be called.

<Modification 1>

In Embodiment 1, description is made on a case where the method for displaying the other vehicle is determined based on the attention level calculated by the attention level calculating unit 104 in step S44 shown in FIG. 4. The present invention, however, is in no way limited to this case.

For example, traveling of the own vehicle may be controlled based on the attention level. Specifically, the controller 107 controls the vehicle control device 116, which controls a semi-automatic operation such as automatic cruising, based on the dynamic state of the driver of the other vehicle. Based on the control performed by the controller 107, the vehicle control device 116 adjusts a distance from the other vehicle so that the distance is increased when there is a need to pay attention to the other vehicle, and the distance becomes equal to a normal distance when there is no need to pay attention to the other vehicle.

In a case where a forward collision warning system is mounted, a warning may be output to the driver earlier than usual when the attention level is high.

As another example, a warning such as an aural warning may be output to the driver of the own vehicle based on the attention level. Specifically, the controller 107 performs control based on the attention level so that a warning is output from the speaker 112 when there is a need to pay attention to the other vehicle.

Consequently, by controlling traveling of the own vehicle and outputting a warning based on the attention level, attention of the driver of the own vehicle can sufficiently be called as in Embodiment 1.

<Modification 2>

In Embodiment 1, description is made on a case where the position of the other vehicle is detected by the other-vehicle position detector 101 by using the ultrasonic sensor 108 or the image sensor 109. The method for detecting the position of the other vehicle, however, is in no way limited to this case. For example, in addition to detecting the position of the other vehicle as in Embodiment 1, a license plate number of the other vehicle, which is information unique to the other vehicle, is recognized through image processing performed by the image sensor 109, and information regarding a license plate number of the other vehicle is acquired from the other-vehicle information received via the communication unit 102. The license plate number recognized by the image sensor 109 and the information regarding the license plate number acquired via the communication unit 102 may be then collated with each other to specify the other vehicle.

Consequently, by specifying the position of the other vehicle based on the information regarding the position of the other vehicle detected by the image sensor 109 connected to the other-vehicle position detector 101 and the information unique to the other vehicle included in the other-vehicle information acquired from the other vehicle, when there are a plurality of other vehicles, the plurality of other vehicles and respective positions of the plurality of other vehicles can each be specified.

<Modification 3>

In Embodiment 1, description is made on a case where the attention level is calculated by the attention level calculating unit 104 included in the on-vehicle information processing device 100 mounted in the vehicle A. The present invention, however, is in no way limited to this case.

For example, the on-vehicle information processing device 200 mounted in the vehicle B may include an attention level calculating unit (not illustrated), and the attention level calculating unit included in the on-vehicle information processing device 200 may calculate the attention level. In this case, information regarding the calculated attention level is transmitted from the vehicle B to the vehicle A by including the information regarding the calculated attention level in the own-vehicle information. In the vehicle A, calling attention of the driver of the vehicle A and traveling of the vehicle A are controlled based on the information regarding the attention level acquired from the vehicle B.

Consequently, by calculating the attention level in the vehicle B, an advantageous effect similar to that obtained in Embodiment 1 can be obtained.

Embodiment 2

In Embodiment 2 of the present invention, description is made on a case where information on the position of another vehicle is acquired from the other vehicle. The on-vehicle information processing device 100 in Embodiment 2 does not include the other-vehicle position detector 101, the ultrasonic sensor 108, and the image sensor 109, which are included in the on-vehicle information processing device 100 in Embodiment 1 (see FIG. 2). The other configuration and operations of the on-vehicle information processing device 100 are similar to those in Embodiment 1. Description on the similar configuration and operations are thus omitted in Embodiment 2.

An own vehicle (hereinafter, the vehicle A) makes a request for communication to another vehicle (hereinafter, the vehicle B) via inter-vehicle communication. When there is a response to the request from the vehicle B (i.e., when communication with the vehicle B is possible), the vehicle A recognizes that the vehicle B exists. The vehicle A then acquires, from the vehicle B, information on the position of the vehicle B via inter-vehicle communication.

Consequently, according to Embodiment 2, since the on-vehicle information processing device 100 does not include the other-vehicle position detector 101, the ultrasonic sensor 108, and the image sensor 109, which are included in the on-vehicle information processing device 100 in Embodiment 1, the configuration can be simplified compared to that in Embodiment 1. Although any method may be used as a method, for use in the other vehicle, for detecting the position of the other vehicle, a method for detecting the position of the other vehicle by using a quasi-zenith satellite is particularly effective as this method has a high position detection accuracy.

Embodiment 3

In Embodiment 3 of the present invention, description is made on a case where communication between an own vehicle (hereinafter, the vehicle A) and another vehicle (hereinafter, the vehicle B) is performed via a predetermined communication network other than inter-vehicle communication. In Embodiment 3, configuration and operations other than not performing inter-vehicle communication are similar to those in Embodiments 1 and 2. Description on the similar configuration and operations are thus omitted in Embodiment 3.

For example, the vehicles A and B may perform communication with each other via a wide area communication network for, for example, mobile phones.

Alternatively, the vehicles A and B may perform communication with each other via dedicated short range communications (DSRC) (registered trademark) or road-to-vehicle communication using a wireless LAN.

When the vehicle A acquires information regarding the position of the vehicle B, the information may be acquired from a device for detecting vehicles installed on a road.

Consequently, according to Embodiment 3, the communication unit 102 in the vehicle A can acquire the other-vehicle information from the vehicle B via a predetermined communication network, and an advantageous effect similar to that obtained in Embodiments 1 and 2 is obtained.

Embodiment 4

In Embodiment 4 of the present invention, description is made on detection of the positions of an own vehicle and another vehicle that travel along a road having a plurality of lanes (travel roads). The other configuration and operations are similar to those in Embodiments 1-3. Description on the similar configuration and operations are thus omitted in Embodiment 4.

Figure 8:
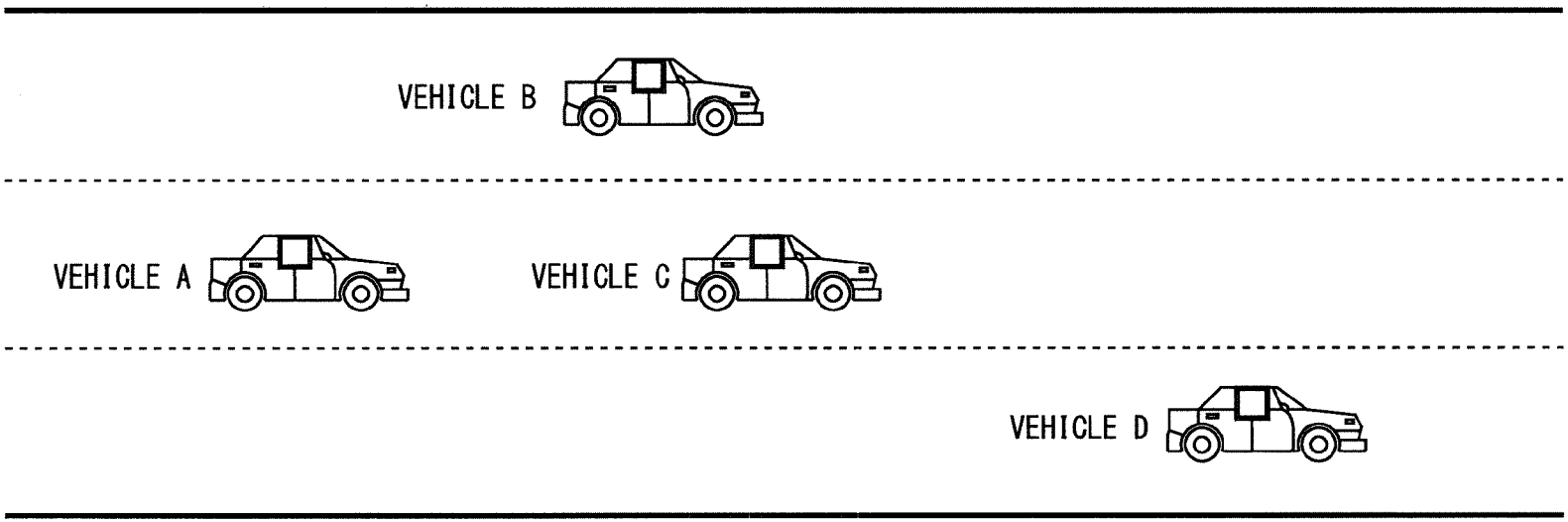
FIG. 8 shows an example of display achieved by an on-vehicle information processing device according to Embodiment 4 of the present invention.

FIG. 8 shows an example of display performed in the own vehicle (the vehicle A) when the vehicle A travels along a road having a plurality of lanes. Vehicles B, C, and D represent other vehicles.

As a method for detecting the positions of the vehicles A-D, lanes along which the respective vehicles A-D travel can be detected based on lane information included in map information stored in the map DB (e.g., the map DBs 105 and 205) provided for each of the vehicles A-D, and information regarding white lines recognized by a camera and the like provided for each of the vehicles A-D (e.g., the image sensor 109 provided for the vehicle A).

As another method, lanes along which the respective vehicles A-D travel can be detected based on the lane information included in the map information stored in the map DB (e.g., the map DBs 105 and 205) provided for each of the vehicles A-D, and information regarding the positions of the respective other vehicles acquired in each of the vehicles A-D by using a quasi-zenith satellite.

In FIG. 8, the vehicle A acquires information regarding lanes along which the respective vehicles B-D travel and the positions of the respective vehicles B-D from the vehicles B-D. That is to say, the positions of the respective vehicles B-D are specified based on information regarding the positions of the respective vehicles B-D included in the other-vehicle information or information specifying travel roads along which the respective vehicles B-D travel included in the other-vehicle information. The positions of the vehicles B-D relative to the position of the vehicle A can be determined based on the information regarding the lanes along which the respective vehicles B-D travel and the positions of the respective vehicles B-D as acquired, and information regarding a lane along which the vehicle A travels and the position of the vehicle A.

Figure 9:
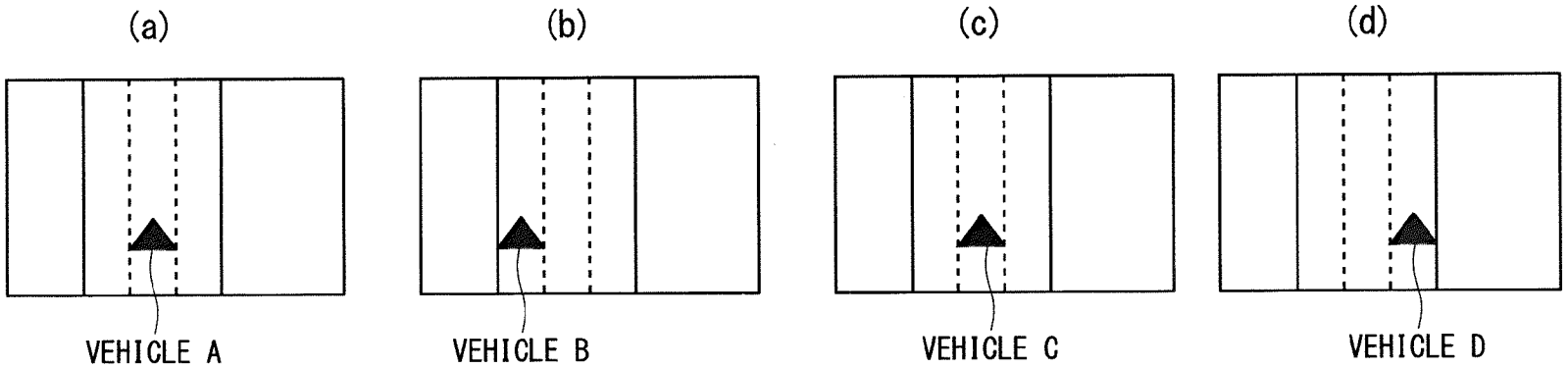
FIG. 9 shows another example of the display achieved by the on-vehicle information processing device according to Embodiment 4 of the present invention.

Portions (a) to (d) of FIG. 9 show, display of the position of an own vehicle performed in the own vehicle. The positions of the other vehicles (the vehicles B-D) on the basis of the position of the own vehicle (the vehicle A) may be displayed in the vehicle A by performing communication, so that it becomes easy for the driver to visually recognize lanes along which the respective vehicles A-D travel. In this case, the other vehicles are displayed so that a manner of displaying each of the other vehicles varies depending on whether attention is to be paid to the other vehicle.

Consequently, according to Embodiment 4, since the positions of the vehicles B-D are specified based on the information regarding the positions of the vehicles B-D included in the other-vehicle information acquired from the vehicles B-D or the information for specifying travel roads along which the respective vehicles B-D travel included in the other-vehicle information acquired from the vehicles B-D, the positions of the vehicles B-D relative to the position of the vehicle A can be determined, and attention of the driver of the own vehicle can be called based on a result of the determination.

Embodiment 5

In Embodiment 5 of the present invention, description is made on calculation of an attention level performed by the attention level calculating unit 104 included in the on-vehicle information processing device 100. In Embodiment 1, the attention level calculating unit 104 calculates two (stages of) attention levels based on the driver dynamic information for another vehicle (hereinafter, the vehicle B). In Embodiment 5, the attention level calculating unit 104 calculates a plurality of (stages of) attention levels based on the driver dynamic information, driver static information, other-vehicle internal information, and position information for the vehicle B. The other configuration and operations in Embodiment 5 are similar to those in Embodiments 1-4. Description on the similar configuration and operations are thus omitted in Embodiment 5.

The amount of task (work) in operating equipment (e.g., the AV device 215 shown in FIG. 3) mounted in a vehicle typically varies among drivers including a young driver, an aged driver, and a beginner driver. Further, a degree of concentration of the driver on driving varies depending on the presence or absence of interaction between the driver and a fellow passenger. In Embodiment 5, by acquiring information indicating states of the driver and the fellow passenger of the other vehicle, the attention level calculating unit 104 can calculate a more detailed attention level.

A level or a coefficient that is determined in advance according to a state of each of the driver dynamic information, the driver static information, the other-vehicle internal information, and the position information is set to each of the driver dynamic information, the driver static information, the other-vehicle information, and the position information. The following describes the level set according to a state of each of the driver dynamic information, the driver static information, the other-vehicle information, and the position information with use of FIGS. 10-13.

FIG. 10 shows an example of a relation between the driver dynamic information and a level.

As shown in FIG. 10, a level L1 is set according to a state of activity (a dynamic state) of the driver of the vehicle B.

In FIG. 10, "listening to music at high volume" refers to a state in which a driver listens to music at a high volume. Further, "decreasing wakefulness" refers to a state in which a driver feels sleepy, for example.

FIG. 11 shows an example of a relation between the driver static information and a level.

As shown in FIG. 11, a level L2 is set according to information that is unique to the driver of the vehicle B.

In FIG. 11, "gold driver's license" refers to a driver's license issued to a good driver (a driver with no accident and no violation during five years before an expiration date of the driver's license) and colored gold.

Further, "normal driver's license" refers to a driver's license issued to a driver other than the good driver and colored green or blue.

Further, "vehicle with drivers' sign display" refers to a vehicle displaying a sign indicating, in particular, a state of the driver. Examples of the vehicle displaying the sign are vehicles displaying a beginner drivers' sign (Shoshinsha mark), an aged drivers' sign (Koreisha mark), a handicapped drivers' sign (Shintaishogaisha mark), and a hard of hearing drivers' sign (Chokakushogaisha mark).

FIG. 12 shows an example of a relation between a state of a fellow passenger and a level.

As shown in FIG. 12, in Embodiment 5, an internal state of the vehicle B indicates a state of a fellow passenger, and a level L3 is set according to the state of the fellow passenger.

A state indicated by "with fellow passenger" corresponding to a level L3 "1" refers to a state in which a fellow passenger keeps silent.

FIG. 13 shows an example of a relation between the position of the vehicle B and a coefficient R.

As shown in FIG. 13, the coefficient R is set according to the position of the vehicle B.

Calculation of the attention level performed by the attention level calculating unit 104 is described next.

The attention level calculating unit 104 acquires the driver dynamic information, the driver static information, the other-vehicle internal information, and the position information for the vehicle B that are included in the other-vehicle information via the communication unit 102 (see step S43 in FIG. 4), and calculates the attention level in accordance with the following equation (1) based on the levels L1, L2, L3, and the coefficient R respectively corresponding to the driver dynamic information, the driver static information, the other-vehicle internal information, and the position information as acquired.

$$\text{Attention level } L = (\text{Dynamic characteristics} + \text{Static characteristics} + \text{Vehicle internal information}) \times \text{Risk coefficient} = (L1 + L2 + L3) \times R \quad (1)$$

The controller 107 controls calling attention of the driver and a semi-automatic operation (controls an inter-vehicle distance) based on the attention level calculated in accordance with the equation (1).

Figures 14, 15:
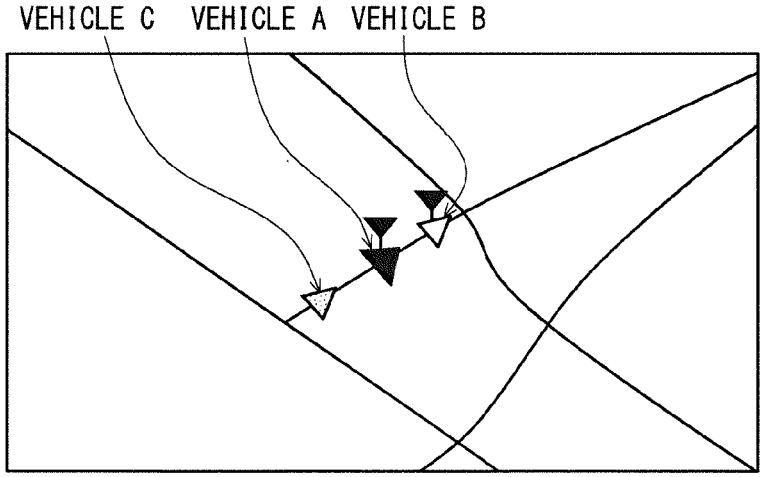
FIG. 14 shows an example of a relation between an attention level and an attention-calling method according to Embodiment 5 of the present invention.
FIG. 15 shows an example of display achieved by an on-vehicle information processing device according to Embodiment 6 of the present invention.

FIG. 14 shows an example of a relation between the attention level L and an attention-calling method.

As shown in FIG. 14, the controller 107 calls attention according to a plurality of attention levels L calculated by the attention level calculating unit 104.

In FIG. 14, "display" indicates examples of display of the vehicle B on a map on the liquid crystal monitor 111.

Further, "sound" indicates examples of a sound output from the speaker 112.

Consequently, according to Embodiment 5, since a plurality of attention levels are calculated based on the driver dynamic information, the driver static information, the other-vehicle internal information, and the position information for the other vehicle (the vehicle B), the controller 107 can appropriately control calling attention and the semi-automatic operation according to a state of the other vehicle (the attention level). For example, because there is a need to pay attention to the other vehicle when passengers have a conversation in the other vehicle, attention of the driver of the own vehicle is called so that the driver of the own vehicle can pay more attention to the other vehicle.

Embodiment 6

In Embodiment 6 of the present invention, description is made on a case where there are another vehicle (hereinafter, a vehicle B) that can communicate with an own vehicle (hereinafter, a vehicle A) and yet another vehicle (hereinafter, a vehicle C) that cannot communicate with the vehicle A, with use of FIGS. 15-19. Configuration and operations in Embodiment 6 are similar to those in Embodiments 1-5. Description on the similar configuration and operations are thus omitted in Embodiment 6.

FIG. 15 shows an example of display performed in the vehicle A.

As illustrated in FIG. 15, the vehicle B travels in front of the vehicle A, and the vehicle C travels behind the vehicle A. Inter-vehicle communication is established between the vehicles A and B (the vehicles A and B can communicate with each other). Therefore, antennas (indicated by down-pointing triangles attached to the respective vehicles A and B) are displayed on the respective vehicles A and B. A manner of displaying the vehicle B may vary depending on the attention level L shown in FIG. 14, for example.

On the other hand, inter-vehicle communication is not established between the vehicles A and C (the vehicles A and C cannot communicate with each other). Therefore, an antenna is not displayed on the vehicle C. When (L1+L2+L3) in the equation (1) is assumed to be 2.5, and the vehicle A travels in front of the vehicle C, the vehicle C is displayed at an attention level L corresponding to 2 shown in FIG. 14, which is obtained by multiplying 2.5 by 1.0 as the risk coefficient R shown in FIG. 13.

Figure 16:
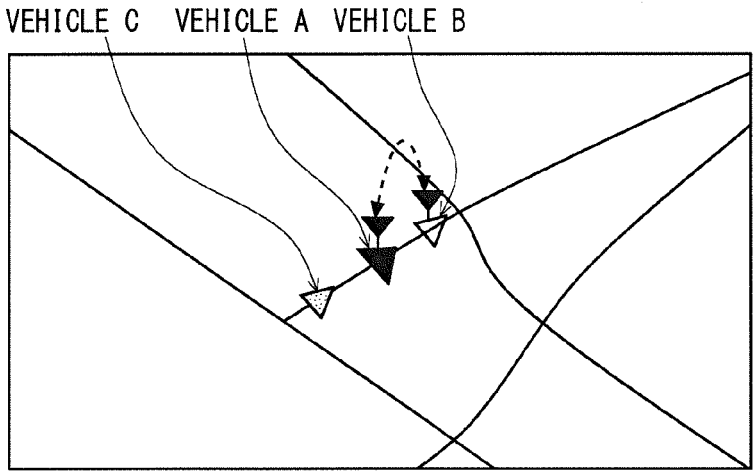
FIG. 16 shows another example of the display achieved by the on-vehicle information processing device according to Embodiment 6 of the present invention.

In FIG. 16, the vehicles A and B are displayed so as to be connected by a dashed arrow. Except for this point, the vehicles A and B are displayed in a similar manner to FIG. 15.

By displaying the vehicles as illustrated in FIG. 16, it becomes easy for the driver to visually recognize that the vehicles A and B establish communication with each other.

Vehicles may be displayed as illustrated in FIG. 15 when they are equipped with terminals capable of communicating with each other but communication is not established between these terminals, and may be displayed as illustrated in FIG. 16 when communication is established and information can be input.

Figure 17:
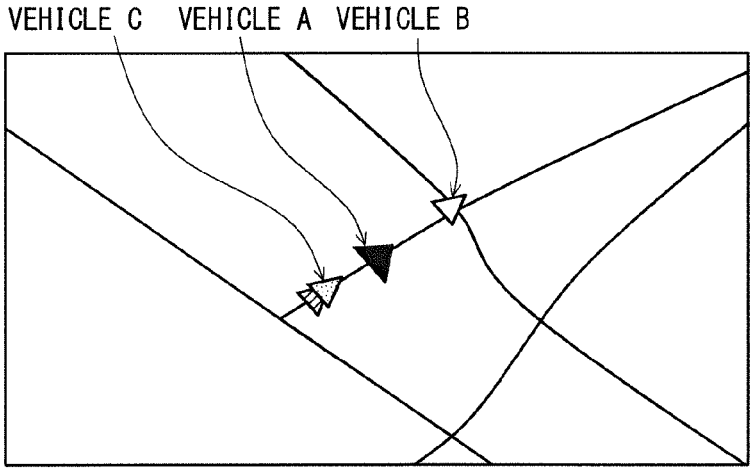
FIG. 17 shows yet another example of the display achieved by the on-vehicle information processing device according to Embodiment 6 of the present invention.

FIG. 17 shows another example of the display performed in the vehicle A.

As illustrated in FIG. 17, the vehicle B travels in front of the vehicle A, and the vehicle C travels behind the vehicle A. Inter-vehicle communication is established between the vehicles A and B (the vehicles A and B can communicate with each other). In this case, there is no need to pay attention to the vehicle B.

On the other hand, inter-vehicle communication is not established between the vehicles A and C (the vehicles A and C cannot communicate with each other). Therefore, the vehicle C is displayed slightly stereoscopically.

Figure 18:
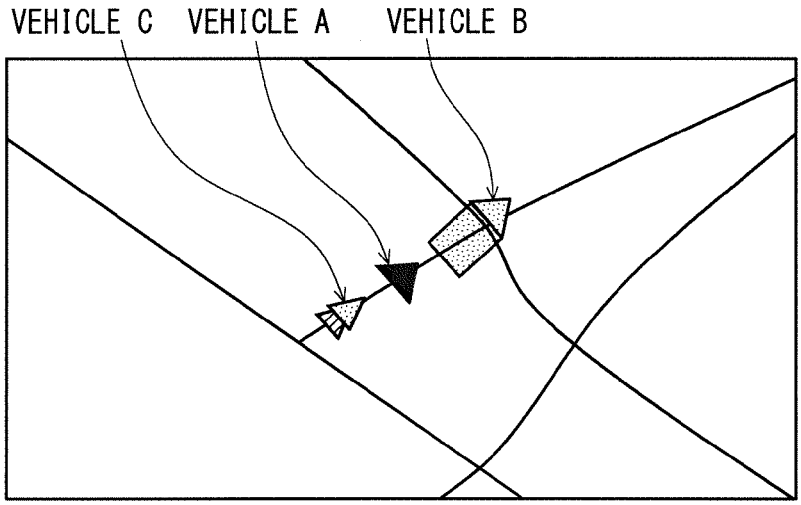
FIG. 18 shows yet another example of the display achieved by the on-vehicle information processing device according to Embodiment 6 of the present invention.

When the state illustrated in FIG. 17 changes to a state in which there is a need to pay attention to the vehicle B, the vehicle B is displayed more stereoscopically than the vehicle C, as illustrated in FIG. 18.

By displaying the vehicles as illustrated in FIG. 18, it becomes easy for the driver of the vehicle A to visually recognize that the vehicle B is a vehicle to which attention should be paid.

Figure 19:
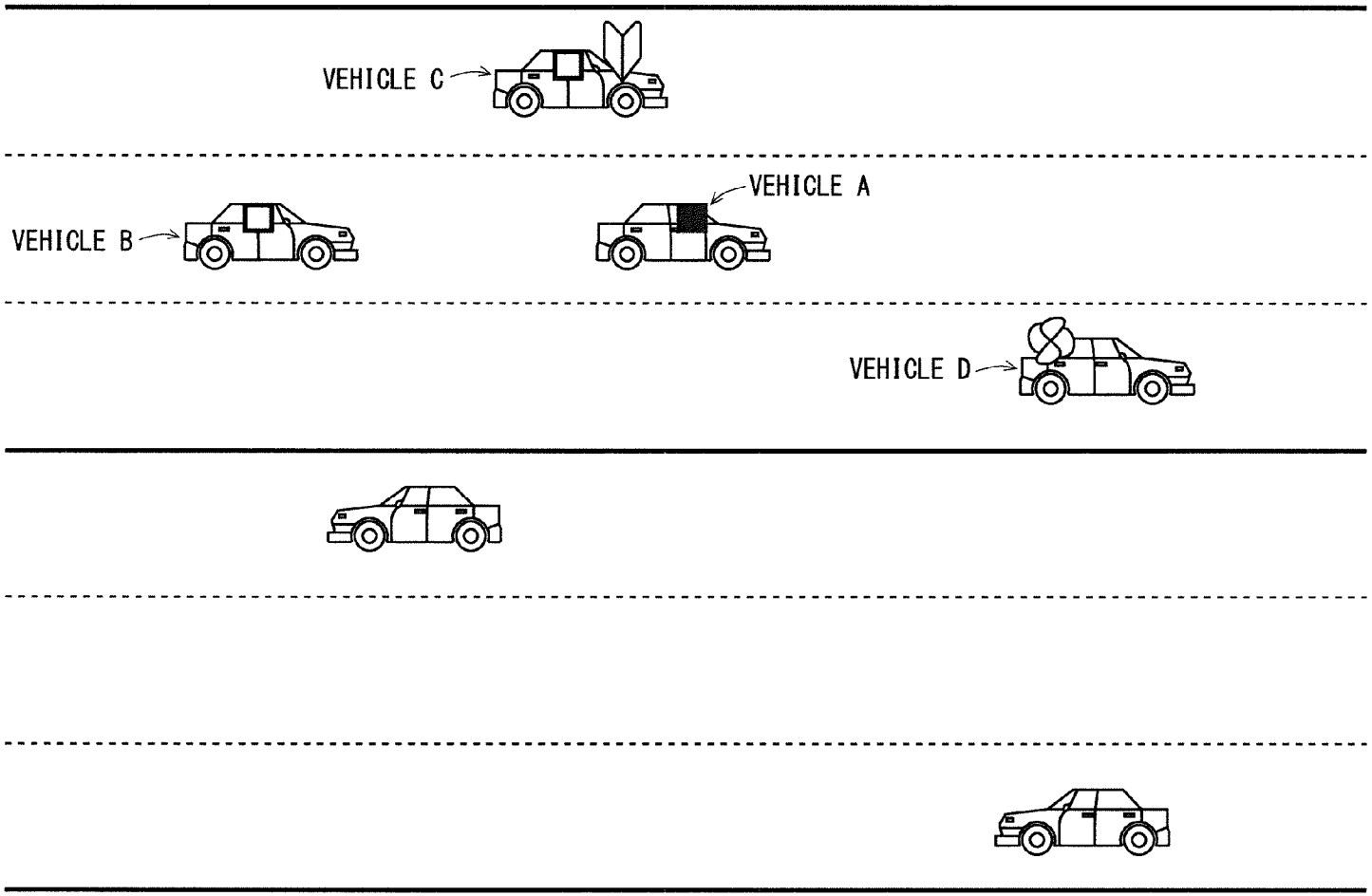
FIG. 19 shows yet another example of the display achieved by the on-vehicle information processing device according to Embodiment 6 of the present invention.

FIG. 19 shows yet another example of the display performed in the vehicle A.

As illustrate in FIG. 19, a solid black square is displayed on the vehicle A, and outlined squares are displayed on the respective vehicles B and C. This indicates that the vehicle A can perform inter-vehicle communication with the vehicles B and C. In addition, a beginner drivers' sign (Shoshinsha mark) is displayed on the vehicle C.

In contrast, no square is displayed on the vehicle D. This indicates that inter-vehicle communication with the vehicle D is not possible. An aged drivers' sign (Koreisha mark) is displayed on the vehicle D.

The beginner drivers' sign (Shoshinsha mark) displayed on the vehicle C and the aged drivers' sign (Koreisha mark) displayed on the vehicle D can be acquired by the image sensor 109 mounted in the vehicle A. Any geometric shapes other than a square may be used as long as a vehicle with which inter-vehicle communication is possible is displayed so as to be distinguished from a vehicle with which inter-vehicle communication is not possible.

Consequently, according to Embodiment 6, since the controller 107 controls the liquid crystal monitor 111 so that a manner of displaying the vehicles B and C on the liquid crystal monitor 111 varies depending on whether communication with the vehicle C is possible or not, and according to the driver dynamic information when communication with the vehicle B is possible, it becomes easy for the driver of the vehicle A to visually recognize states of the other vehicles. Accordingly, attention of the driver can sufficiently be called. Furthermore, the controller 107 can also control traveling of the vehicle A depending on whether communication with the vehicle C is possible or not, and according to the driver dynamic information when communication with the vehicle B is possible.

Embodiment 7

In Embodiment 7 of the present invention, description is made on a case where an on-vehicle information processing device has both a function of a transmitting end that transmits own-vehicle information and a function of a receiving end that receives other-vehicle information transmitted from another vehicle.

Figure 20:
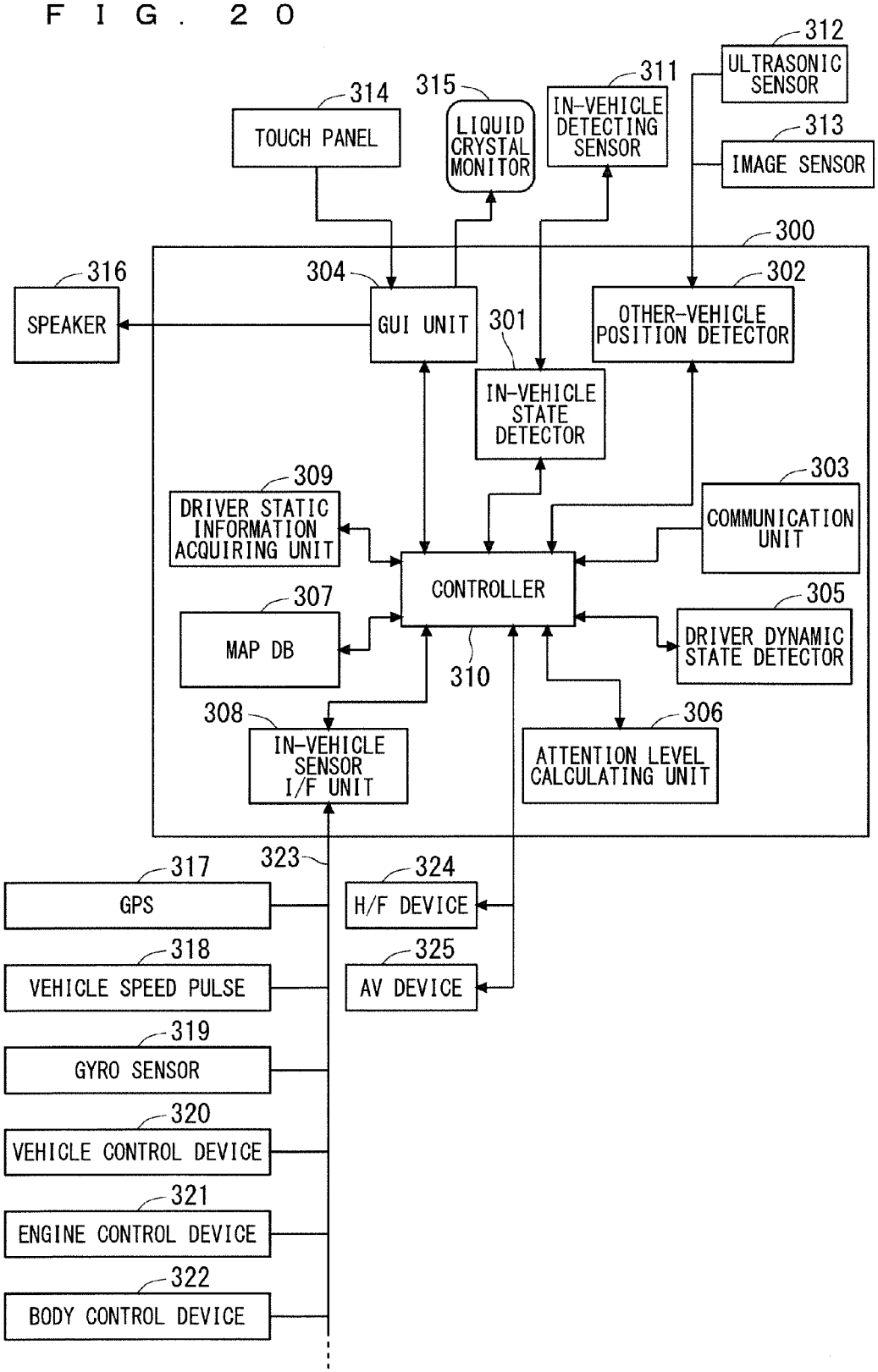
FIG. 20 is a block diagram showing an example of a configuration of an on-vehicle information processing device according to Embodiment 7 of the present invention.

FIG. 20 shows an example of a configuration of an on-vehicle information processing device 300 according to Embodiment 7.

As shown in FIG. 20, the on-vehicle information processing device 300 has a configuration that is a combination of the configuration of the on-vehicle information processing device 100 shown in FIG. 2 and the configuration of the on-vehicle information processing device 200 shown in FIG. 3. The configuration and operations of the on-vehicle information processing device 300 are similar to those of the on-vehicle infatuation processing devices 100 and 200 in Embodiments 1-6. Description on the similar configuration and operations are thus omitted in Embodiment 7.

Consequently, according to Embodiment 7, since the on-vehicle information processing device 300 has the function of the transmitting end and the function of the receiving end, drivers of vehicles equipped with the on-vehicle information processing devices 300 can pay attention to one another.

In FIG. 2, the controller 107 is described to detect the position of an own vehicle based on information acquired by each of the GPS 113, the vehicle speed pulse 114, and the gyro sensor 115. However, the in-vehicle sensor I/F unit 106 may have the function of detecting the position of the own vehicle.

In Embodiment 1, description is made on a case where a relative position of the other vehicle existing in the vicinity of the own vehicle is detected by using the ultrasonic sensor 108 or the image sensor 109. The method for detecting the position of the other vehicle is in no way limited to this method. For example, an absolute position of the other vehicle may be detected by adding information on the position of the own vehicle acquired by the GPS 113 to the result of detection performed by the ultrasonic sensor 108 or the image sensor 109.

In Embodiment 1, description is made on a case where a single vehicle (the vehicle B) is detected as the other vehicle in FIG. 4. However, a plurality of vehicles may be detected as the other vehicles. For example, when a plurality of other vehicles are detected in step S42 in FIG. 4, the priority of detection may be determined based on the coefficient R set according to the position of each of the other vehicles relative to the own vehicle as shown in FIG. 13. Specifically, when there are other vehicles traveling in front of and behind the own vehicle, the other vehicle traveling in front of the own vehicle is detected first, and the other-vehicle information is acquired from the other vehicle traveling in front of the own vehicle. Then, the other vehicle traveling behind the own vehicle is detected, and the other-vehicle information is acquired from the other vehicle traveling behind the own vehicle. That is to say, other vehicles may be detected in descending order of value of the coefficient R shown in FIG. 13. Notwithstanding the foregoing, a user may optionally set the priority, and may optionally set a position of a vehicle to be detected preferentially. Furthermore, the priority may be set based on the attention level calculated by the attention level calculating unit 104 (e.g., in descending order of attention level). As for control of a semi-automatic operation (control of traveling), the priority may be set in a similar manner to the above.

In FIG. 6, as an example of the display when there is a need to pay attention to the vehicle B, the vehicle B is displayed by being filled with a given color. The display of the vehicle B, however, is in no way limited to this example. For example, the vehicle B may be displayed in 3D or in a large size.

In Embodiment 5, the own vehicle (the vehicle A) acquires the driver static information from the other vehicle (the vehicle B). Once the driver static information is acquired, the driver static information may not be acquired thereafter.

In Embodiment 5, an equation to calculate the attention level is not limited to the equation (1). For example, the driver of the own vehicle (the vehicle A) may set any equation.

In Embodiment 5, the attention level calculating unit 104 calculates the attention level based on the driver dynamic information, the driver static information, the other-vehicle internal information, and the position information for the other vehicle (the vehicle B). The attention level, however, may be calculated based on a combination of any of the driver dynamic information, the driver static information, the other-vehicle internal information, and the position information. The attention level as calculated may have three or more stages as shown in FIG. 14, or may have two stages as in Embodiment In FIG. 11, "gold driver's license", "normal driver's license", and "vehicle with drivers' sign display" are taken as examples of the driver static information. These examples of the driver static information conform to traffic rules in Japan. In countries other than Japan, the level L2 is set according to information corresponding to the information shown in FIG. 11.

In FIGS. 10-13, values of the levels L1-L3 and the coefficient R may be any values. For example, the driver of the own vehicle (the vehicle A) may set any values.

In FIG. 14, the attention-calling method may optionally be changed. For example, the driver of the own vehicle (the vehicle A) may set any attention-calling method. While examples of display of the other vehicle are shown in FIG. 14, the other vehicle may have any color, color density, shape, and a degree of a stereoscopic effect. For example, a number indicating the attention level L may be displayed next to or in a geometric shape indicating the other vehicle. That is to say, vehicles may be displayed in any manner as long as a manner of displaying the other vehicle varies depending on the attention level L.

In Embodiment 6, inter-vehicle communication is described as an example of communication. However, other types of communication may be performed (see, for example, Embodiment 3).

In each of Embodiments 1-7, calling attention of the driver of the own vehicle and traveling of the own vehicle (an inter-vehicle distance) are controlled based on the attention level calculated by the attention level calculating unit 104. Alternatively, a collision warning may be output. For example, the ultrasonic sensor 108 may detect a distance from the other vehicle, and, when the detected distance becomes equal to or shorter than a predetermined distance, a warning may be output from the liquid crystal monitor 111 or the speaker 112. In this case, an inter-vehicle distance set as a threshold for outputting the warning may vary depending on the attention level. For example, when the value of the attention level is large, a long inter-vehicle distance may be set. When there is another vehicle with which communication is not possible, a long inter-vehicle distance may be set.

It should be noted that the present invention can be implemented by freely combining the above embodiments or by making modifications or omissions to the embodiments as appropriate without departing from the scope of the present invention.

While the present invention has been described in detail, the foregoing description is in all aspects illustrative and not restrictive. It is therefore to be understood that numerous modifications can be devised without departing from the scope of the invention.

REFERENCE SIGNS LIST

100 On-vehicle information processing device
101 Other-vehicle position detector
102 Communication unit
103 GUI unit
104 Attention level calculating unit
105 Map DB
106 In-vehicle sensor I/F unit
107 Controller
108 Ultrasonic sensor
109 Image sensor
110 Touch panel
111 Liquid crystal monitor
112 Speaker
113 GPS
114 Vehicle speed pulse
115 Gyro sensor
116 Vehicle control device
117 Engine control device
118 Body control device
119 In-vehicle LAN
200 On-vehicle information processing device
201 In-vehicle state detector
202 Communication unit
203 GUI unit
204 Driver dynamic state detector
205 Map DB
206 Position detector
207 Driver static information acquiring unit
208 Controller
209 In-vehicle detecting sensor
210 Touch panel
211 Liquid crystal monitor
212 GPS
213 Vehicle speed pulse
214 H/F device
215 AV device
300 On-vehicle information processing device
301 In-vehicle state detector
302 Other-vehicle position detector
303 Communication unit
304 GUI unit
305 Driver dynamic state detector
306 Attention level calculating unit
307 Map DB
308 In-vehicle sensor I/F unit
309 Driver static information acquiring unit
310 Controller
311 In-vehicle detecting sensor

312 Ultrasonic sensor
313 Image sensor
314 Touch panel
315 Liquid crystal monitor
316 Speaker
317 GPS
318 Vehicle speed pulse
319 Gyro sensor
320 Vehicle control device
321 Engine control device
322 Body control device
323 In-vehicle LAN
324 H/F device
325 AV device

The invention claimed is:

1. An on-vehicle information processing device comprising:

an other-vehicle position detector that detects a position of another vehicle existing in a vicinity of an own vehicle;

a communication unit that acquires, via communication, other-vehicle information including driver dynamic information from said other vehicle whose position is detected by said other-vehicle position detector, said driver dynamic information indicating a current state of activity of a driver of said other vehicle; and a controller that controls calling attention of a driver of said own vehicle or traveling of said own vehicle based on said driver dynamic information acquired by said communication unit.

2. The on-vehicle information processing device according to claim 1, wherein said driver dynamic information includes information indicating an operating state of in-vehicle equipment that is operable by said driver of said other vehicle and exists in said other vehicle.

3. The on-vehicle information processing device according to claim 2, wherein said operating state is a state in which said in-vehicle equipment is operated.

4. The on-vehicle information processing device according to claim 2, wherein said operating state is a state in which said in-vehicle equipment is connected to a portable communication terminal.

5. The on-vehicle information processing device according to claim 2, wherein said operating state is a state in which, via said in-vehicle equipment, hands-free communication is performed or an outgoing hands-free call is initiated.

6. The on-vehicle information processing device according to claim 1, wherein said driver dynamic information includes information indicating an information presenting state of in-vehicle equipment to said driver of said other vehicle, said in-vehicle equipment existing in said other vehicle.

7. The on-vehicle information processing device according to claim 6, wherein said presenting state is a state in which said in-vehicle equipment outputs music at a volume that is equal to or higher than a predetermined volume.

8. The on-vehicle information processing device according to claim 6, wherein said presenting state is a state in which said in-vehicle equipment announces an incoming call.

9. The on-vehicle information processing device according to claim 6, wherein said presenting state is a state in which information acquired from an outside source is presented to said driver of said other vehicle.

10. The on-vehicle information processing device according to claim 1, wherein said driver dynamic information includes information regarding a travel history or a travel schedule of said driver of said other vehicle on a current day.

11. The on-vehicle information processing device according to claim 1, wherein said communication unit acquires said other-vehicle information from said other vehicle via inter-vehicle communication or via a predetermined communication network.

12. The on-vehicle information processing device according to claim 1, further comprising a display, wherein said controller controls said display so that a manner of displaying said other vehicle on said display varies depending on whether communication with said other vehicle is possible or not, and according to said driver dynamic information when communication with said other vehicle is possible.

13. The on-vehicle information processing device according to claim 1, wherein said controller controls traveling of said own vehicle depending on whether communication with said other vehicle is possible or not, and according to said driver dynamic information when communication with said other vehicle is possible.

14. The on-vehicle information processing device according to claim 1, wherein said other-vehicle information includes driver static information that is unique to said driver of said other vehicle.

15. The on-vehicle information processing device according to claim 1, wherein said other-vehicle information includes other-vehicle internal information that indicates an internal state of said other vehicle.

16. The on-vehicle information processing device according to claim 1, further comprising an attention level calculating unit that calculates, based on said other-vehicle information, an attention level to be paid to said other vehicle, wherein said controller controls calling attention of said driver of said own vehicle or traveling of said own vehicle based on said attention level calculated by said attention level calculating unit.

17. An on-vehicle information processing device comprising:

a driver dynamic state detector that detects a current state of activity of a driver of an own vehicle;

a communication unit that transmits, via communication, own-vehicle information including driver dynamic information to another vehicle, said driver dynamic information indicating said current state of activity detected by said driver dynamic state detector; and a controller that controls said communication unit.

18. The on-vehicle information processing device according to claim 17, wherein said controller controls said communication unit so that said communication unit transmits said own-vehicle information to said other vehicle upon request for communication from said other vehicle.

19. The on-vehicle information processing device according to claim 17, further comprising a driver static information acquiring unit that acquires driver static information that is unique to said driver of said own vehicle, wherein said controller controls said communication unit so that said communication unit transmits said driver static information acquired by said driver static information acquiring unit to said other vehicle by including said driver static information in said own-vehicle information.

20. The on-vehicle information processing device according to claim 17, further comprising an in-vehicle state detector that detects an internal state of said own vehicle, wherein said controller controls said communication unit so that said communication unit transmits, as own-vehicle internal information, information indicating said internal state of said own vehicle detected by said in-vehicle state detector to said other vehicle by including said own-vehicle internal information in said own-vehicle information.

* * * * *